US006769535B2

(12) United States Patent
Zilker et al.

(10) Patent No.: US 6,769,535 B2
(45) Date of Patent: Aug. 3, 2004

(54) HIGH DRAINAGE DIMENSIONALLALLY STABLE BROWNSTOCK WASHER BELT DESIGN

(75) Inventors: Gregory Zilker, Brush Prairie, WA (US); Mark Levine, Hendersonville, TN (US); John VanHandel, Appleton, WI (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/289,990

(22) Filed: Nov. 7, 2002

(65) Prior Publication Data

US 2004/0089521 A1 May 13, 2004

(51) Int. Cl.[7] ..... B65G 15/34
(52) U.S. Cl. ..... 198/847
(58) Field of Search ..... 198/847, 846; 139/383 A

(56) References Cited

U.S. PATENT DOCUMENTS 5,094,719 A * 3/1992 Fry ..... 139/383 A
5,152,326 A 10/1992 Vohringer ..... 139/383 A
5,158,117 A 10/1992 Huhtiniemi ..... 139/383 A
5,169,709 A 12/1992 Fleischer ..... 428/225
5,234,551 A * 8/1993 Dutt et al. ..... 198/847
5,275,024 A 1/1994 Parks ..... 68/9
5,421,374 A 6/1995 Wright ..... 139/383 A
5,938,007 A * 8/1999 Fujihiro et al. ..... 198/847
6,077,397 A 6/2000 Shipley ..... 139/383 A X
6,179,013 B1 * 1/2001 Gulya ..... 139/383 A
6,276,402 B1 * 8/2001 Herring ..... 139/383 A
6,354,335 B1 * 3/2002 Taipale et al. ..... 139/383 A
6,413,377 B1 * 7/2002 Wright ..... 139/383 A

* cited by examiner

*Primary Examiner*—James R. Bidwell
(74) *Attorney, Agent, or Firm*—Frommer Lawrence & Haug, LLP; Ronald R. Santucci

(57) ABSTRACT

A belt suitable in a brownstock washer machine and a method of producing the same are provide. The belt is produced from a high-density multi-layer woven fabric, which is preferably made using an eight-shed weave pattern. The fabric provides high fiber support via a high warp-density/long-warp-float while achieving high drainage/resistance-to-sealing through increased void volume.

45 Claims, 6 Drawing Sheets

SHUTE CONTOURS

WARP CONTOURS

SHUTE CONTOURS

WARP CONTOUR

SHUTE CONTOURS

WARP CONTOURS

HIGH DRAINAGE DIMENSIONALLALLY STABLE BROWNSTOCK WASHER BELT DESIGN

FIELD OF THE INVENTION

The present invention is directed towards the preparation of wood pulp for use in paper production, and more particularly, towards the brownstock washing of pulp to be used in paper production.

BACKGROUND OF THE INVENTION

The production of paper begins with the processing of wood. Wood is chiefly composed of two major substances; both are organic, that is, their molecules are built around chains and rings of carbon atoms. Cellulose, which occurs in the walls of the plant cells, is the fibrous material that is used to make paper. Lignin is a large, complex molecule; it acts as a kind of glue that holds the cellulose fibers together and stiffens the cell walls, giving wood its mechanical strength. In order to convert wood into pulp suitable for making paper, the cellulose fibers must be freed from the lignin. In mechanical pulping this is done by tearing the wood fibers apart physically to create groundwood pulp, leaving most of the lignin intact in the pulp. The high lignin content of groundwood pulp leaves the paper products weak and prone to degradation (e.g. yellowing) over time. Mechanical pulp is used principally to manufacture newsprint and some magazines.

In most pulp production lignin is separated from the fibers chemically. For example, in the kraft process, wood chips are heated ("cooked") in a solution of sodium hydroxide and sodium sulfide. The lignin is broken down into smaller segments and dissolves into the solution. In the next step, "brownstock washing," the breakdown products and chemicals are washed out of the pulp and sent to the recovery boiler. Kraft unbleached pulp has a distinctive dark brown color, due to darkened residual lignin, but is nevertheless exceptionally strong and suitable for packaging, tissue and toweling.

For brighter and more durable products the pulp must be bleached. In the bleaching process, the color in the residual lignin is either neutralized (by destroying the chromophoric groups) or removed with the lignin. This process traditionally has been accomplished for kraft pulp by chlorine bleaching, usually followed by washing and extraction of the chemicals and breakdown products. This process is not much different than washing clothes, the stains imbedded in cloth fibers are either neutralized by bleach, or broken down and washed out.

In current pulp production processes, the lignin solution typically undergoes two or more separate washing operations. For example, the groundwood or wood chips are first processed with chemicals under pressure and temperature, usually by either the kraft process or by the sulfite acid process. In either process, digestion dissolves the lignins thereby freeing the fibers and placing the lignin components into solution. In both processes the resulting liquid is dark in color, and the residual liquid which does not drain from the pulp and the remaining contaminants must be washed from the pulp. Further, it is desirable to recover spent liquid at as high a concentration as practical to minimize the cost of the subsequent recovery of chemicals.

Brown pulp which has been so washed retains a definite brown color and the pulp which remains is usually too highly colored for making white paper. Also, if any lignin is present, paper made from such pulp may not have a high degree of permanence and will yellow in time. Therefore, it is common and conventional to apply a bleaching process to the pulp, not only to improve whiteness, but to improve permanence of the whiteness.

The bleaching commonly is performed in a chlorination stage by applying a water in which chlorine gas has been dissolved. Other bleaching processes may be used, such as a sodium hydrosulphite process, as is well known in the art. Three chemicals that are commonly used in current bleaching operations are sodium hydroxide (NaOH), chlorine dioxide ($ClO_2$) and hydrogen peroxide ($H_2O_2$). Bleaching may not be accomplished in a single stage and may be performed in two or more stages, each followed by washing. After bleach treatments, the pulp is subjected to a washing action to remove the water which contains the spent bleaching agents and dissolved lignin.

U.S. Pat. No. 5,275,024 shows an example of a current belt-type pulp washing machine that includes a dewatering stage (or "formation zone") and multiple of counter-current washing stages (or collectively "displacement zone"). The machine employs an endless moving foraminous belt which extends about a breast roll defining an on-running end and a couch roll defining an off-running end, with a generally horizontal upper run of the belt extending between the rolls. A series of suction boxes located underneath the belt provide for initial dewatering of the pulp in the formation zone, and combine with a series of showers to provide washing and dewatering in the displacement zone.

The machine downstream from the headbox and the forming zone is divided into a series of washing zones or stages to which a washing liquid is applied from above for drainage through the mat. The freshest or cleanest washing liquid is applied to the zone nearest the off-running end of the wire and the liquid drained through the mat at that zone is collected from the suction boxes and delivered to the immediately preceding washing zone. This is repeated from zone to zone, so that the cleanest pulp is treated with the cleanest water, and the dirtiest pulp is treated with the dirtiest water.

SUMMARY OF THE INVENTION

The inventors of the present invention have recognized several deficiencies of prior tensioned belt brownstock washer belts.

In particular, the inventors have noted that current belt designs primarily include two alternative types, a high permeability, low support double layer type and a low permeability, high support single layer type. The double layer designs achieve a high drainage rate through high permeability and are appropriate for use with long wood fiber (soft wood), but exhibit sealing problems with short fiber (hard wood). The single layer designs prevent sealing with high support via low permeability, but sacrifice drainage rate.

More generally, the more open the prior art design, the less support it provides, thereby giving rise to "sealing" problems. That is, the open prior art designs allow the fibers in the pulp mat to impinge into the belt, increasing the pulp density locally between the filaments in the belt, and thus adding resistance to flow/drainage. The machine operators can turn up the vacuums to compensate, but this increases the drag on the belt, increases abrasion and reduces service life.

In addition, the inventors of the present invention have recognized that prior tensioned belt brownstock washers such as the washer discussed in U.S. Pat. No. 5,275,024, typically employ belts that are fabricated from 100% polyamide based monofilaments (for caustic applications) or 100% polyester based monofilaments (for acidic applications); and that there are significant design deficiencies with such belts.

One of the deficiencies associated with the materials used in prior washer belts is that polyamide based fabrics tend to be dimensionally unstable in both the machine direction (MD) and the cross-machine direction (CD), which make the belts difficult to install and cause run problems as a result of growth or shrinkage outside the machine design limits. For example, MD shrinkage can result in fabrics being too short for installation while MD stretch can result in fabric lengths in excess of equipment take-up mechanisms, causing unacceptably low running tensions.

Another deficiency is that CD growth, due to water absorption, can result in fabric end to end mismatch, creating seam pinning delays, misaligned loops during pinning (weak seam), and excess width leading to excessive edge wear, abrasion, unraveling, lost production time to trim excess width, and seam rupture.

Other deficiencies include: CD shrinkage resulting in direct exposure of the pulp to the vacuum box, corrupting the basic washing process; lack of MD and CD stability, as a result of water absorption which occurs over the first few hours after installation, requiring that a break-in period be endured prior to applying stock to start washing production; the inherently hydrophilic nature of polyamide materials resulting in increased contaminant surface adhesion and a continuous decrease in drainage performance over the life of the product; and the short life span of polyester based fabrics in the presence of acidic chemical degradation giving rise to the need for adding high levels of hydrolytic chemical stabilizer to the monofilaments of the fabric.

In order to overcome the drawbacks of prior washer belts, the washer belt of the present invention is produced from a high-density multi-layer woven fabric.

BRIEF DESCRIPTION OF THE DRAWINGS

Thus by the present invention, its objects and advantages will be realized, the description of which should be taken in conjunction with the drawings wherein.

DETAILED DESCRIPTION OF THE PREFERRED EMBODIMENTS

In view of the deficiencies of prior washer-belt designs, the present invention details a set of fabric design and material selection for a washer belt that provides greatly improved brownstock washing performance on a brownstock washer machine. Although the belt of the invention is applicable to a wide range of brownstock washers, it is envisioned that the belt would be particularly advantageous in washers like the Black Clawson Chemi-Washer®.

The belt is produced from a high-density multi-layer woven fabric. The fabrics may be seamed to form an endless structure for belt use or may be woven endless. In seamed embodiments, a woven seam, a pin seam or a pin spiral seam may be used. In any event, the fabric provides high fiber support via a high warp-density/long-warp-float while achieving high drainage/resistance-to-sealing through increased void volume. The structure of the fabric may be referred to as "long warp knuckle up."

Figure 1A:
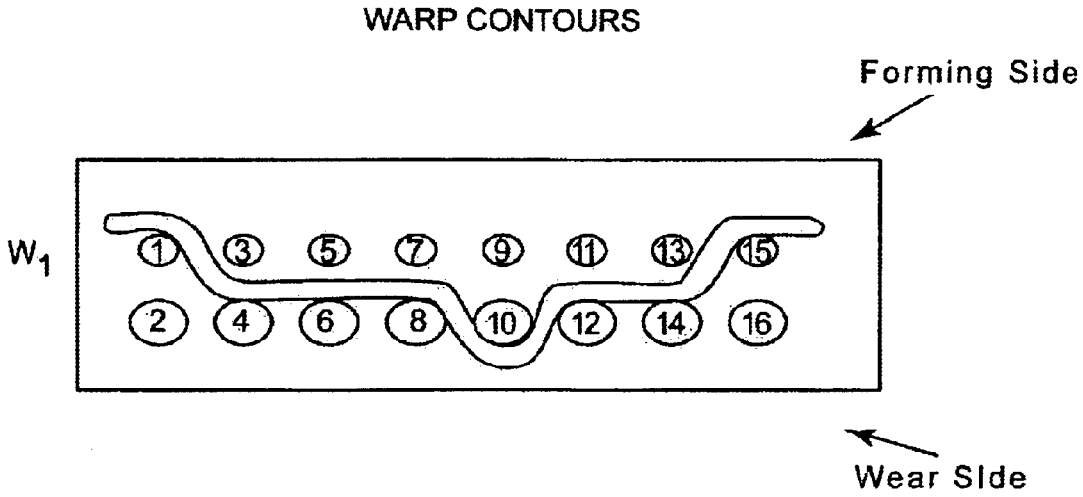
FIG. 1A is a graphic representation of the weave pattern of a first embodiment of a belt fabric according to the invention when viewed along the direction of the shute filaments.

A preferred fabric design of the present belt is an eight-shed, double layer design. FIG. 1A is a graphic representation of the weave pattern for the preferred fabric when viewed along the direction of the shute filaments. As can be seen from FIG. 1A, a warp filament w1 traverses a path between two layers of shute filaments, a first layer defined by shute filaments 1, 3, 5, 7, 9, 11, 13 and 15, and a second layer defined by shute filaments 2, 4, 6, 8, 10, 12, 14 and 16. This pattern repeats every time the warp yarn crosses eight shute filaments of a layer.

Figure 1B:
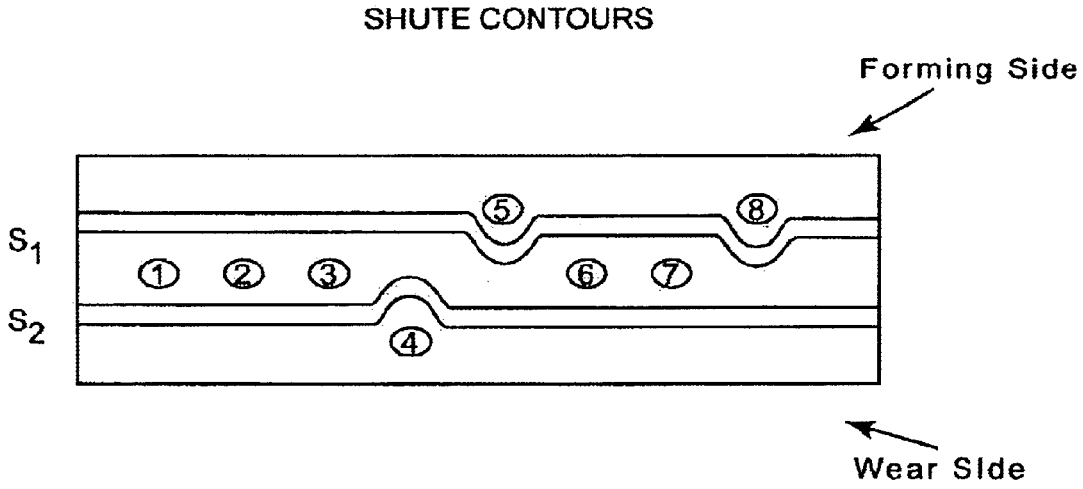
FIG. 1B is a graphic representation of the weave pattern of a first embodiment of a belt fabric according to the invention when viewed along the direction of the warp filaments.

FIG. 1B is a graphic representation of the weave pattern of the fabric of FIG. 1A when viewed along the direction of the warp filaments. As can be seen from FIG. 1B, a shute filament s1 of the upper shute layer traces a first path through warp filaments 1–8, and a shute filament s2 of the lower shute layer traces a second path through warp filaments 1–8. The pattern for each of shute filaments s1 and s2 repeats every time the shute filament crosses eight warp filaments.

In FIGS. 1A and 1B, the side of the fabric that will contact the wood pulp is denoted as the "forming side," and the side of the fabric that will contact the machine rolls is denoted as the "wear side."

It should be noted that, although the term filament is being used to describe the invention, the invention is not limited to filaments as defined in the strict sense. Rather, the term filament is used to denote fibers, threads, yarns, filaments, monofilaments, multifilaments, and the like. Thus, the belt fabric of the invention may be woven from any one of these types of materials or from any combination of these types of materials. Furthermore, the materials used to weave the fabric may be naturally occurring or synthetic. Still further, it is possible to use metal as a material in the formation of the belt. For instance, metallic or sintered metallic yarns may be used, or a yarn having a sintered metal sheath on a mono core can be used. It is also possible to use combinations of various types of metal materials in the formation of the belt.

Figure 2A:
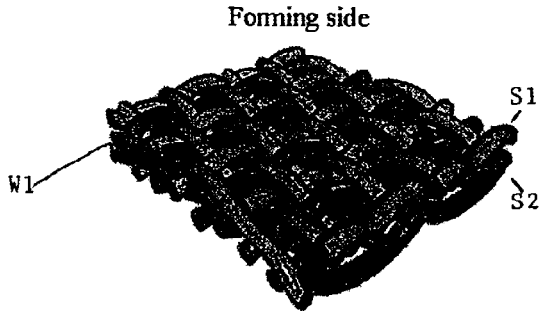
FIG. 2A is a perspective view of the forming side of the belt fabric of FIGS. 1A and 1B.
Figure 2B:
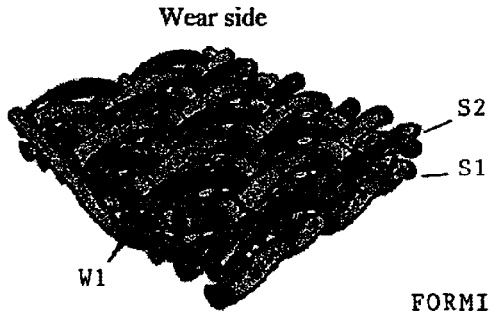
FIG. 2B is a perspective view of a the wear side of the of the belt fabric of FIGS. 1A and 1B.

Referring back to the figures, FIGS. 2A and 2B are perspective views of the fabric of FIGS. 1A and 1B. FIG. 2A is a perspective view of the forming side of the fabric and FIG. 2B is a perspective view of the wear side of the of the fabric. In each of FIGS. 2A and 2B, the path of warp filament w1 and of shute filaments s1 and s2 is shown.

Figure 3A:
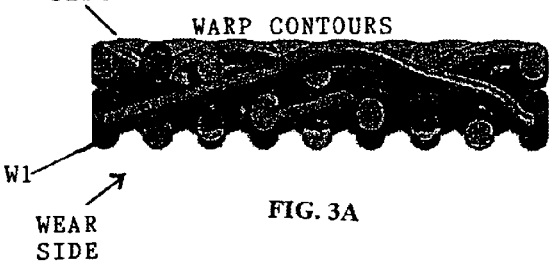
FIG. 3A is a cross-sectional view of the belt fabric of FIGS. 1A and 1B when viewed along the direction of the shute filaments.

FIG. 3A is a cross-sectional view of the belt fabric of FIGS. 1A and 1B when viewed along the direction of the shute filaments. The path of warp filament w1 is shown.

Figure 3B:
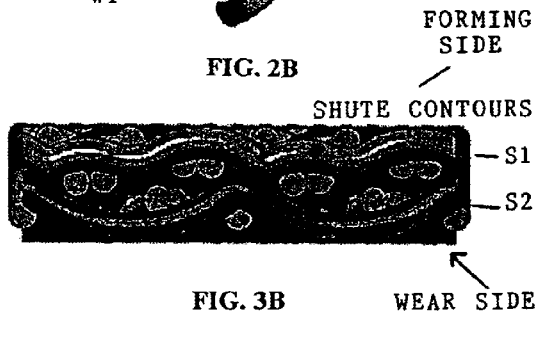
FIG. 3B is a cross-sectional view of the belt fabric of FIGS. 1A and 1B when viewed along the direction of the warp filaments.

FIG. 3B is a cross-sectional view of the belt of FIGS. 1A and 1B when viewed along the direction of the warp filaments. The paths of shute filaments s1 and s2 are shown.

Figure 4A:
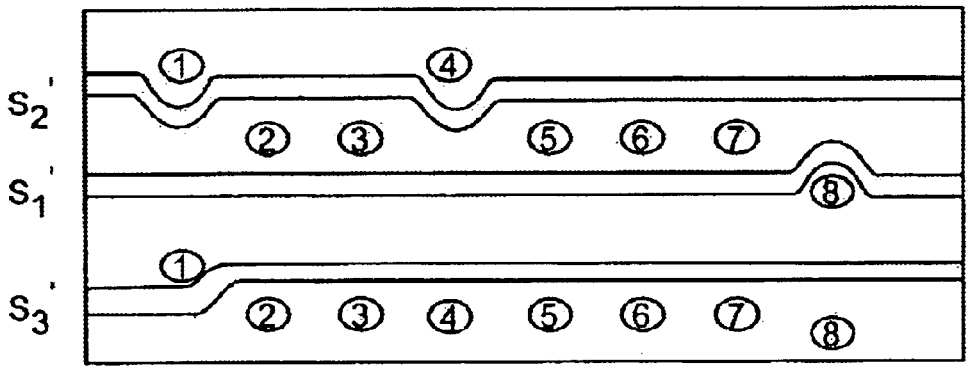
FIG. 4A is a graphic representation of the weave pattern of a second embodiment of a belt fabric according to the invention when viewed along the direction of the warp filaments.
Figure 4B:
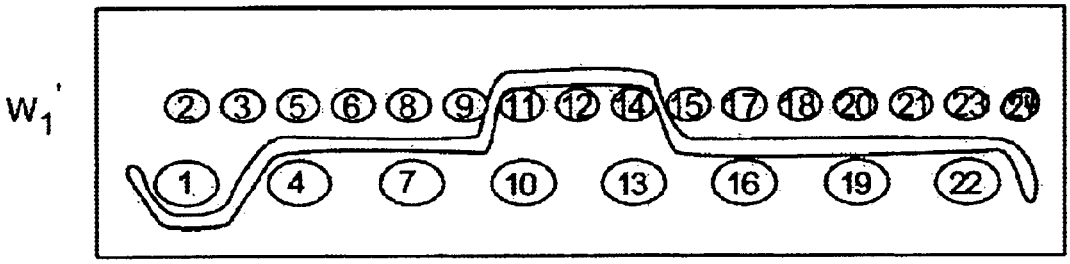
FIG. 4B is a graphic representation of the weave pattern of a second embodiment of a belt fabric according to the invention when viewed along the direction of the shute filaments.

FIGS. 4A and 4B are graphic representations of the weave pattern of a second embodiment of a belt fabric according to the invention, a double layer design including a support shute. FIG. 4A shows the pattern when viewed along the direction of the warp filaments. As can be seen from FIG. 4A, a shute filament s1' of the first shute layer traces a first path through warp filaments 1–8, a shute filament s2' of the second shute layer traces a second path through warp filaments 1–8, and a support shute s3' traces a third path through warp filaments 1–8. The pattern for each of shute filaments s1', s2' and s3' repeats every time the shute filaments cross eight warp filaments.

FIG. 4B shows the double layer with support shute embodiment when viewed along the direction of the shute filaments. As shown in FIG. 4B, a warp filament w1' traverses a path between two layers of shute filaments and a multiple of support shute filaments. The first layer is defined by shute filaments 2, 5, 8, 11, 14, 17, 20 and 23, the second layer is defined by shute filaments 1, 4, 7, 10, 13, 16, 19 and 22, and the support shute filaments are defined by filaments 3, 6, 9, 12, 15, 18, 21 and 24. This pattern repeats every time the warp yarn crosses eight shute filaments of a layer.

Figure 5A:
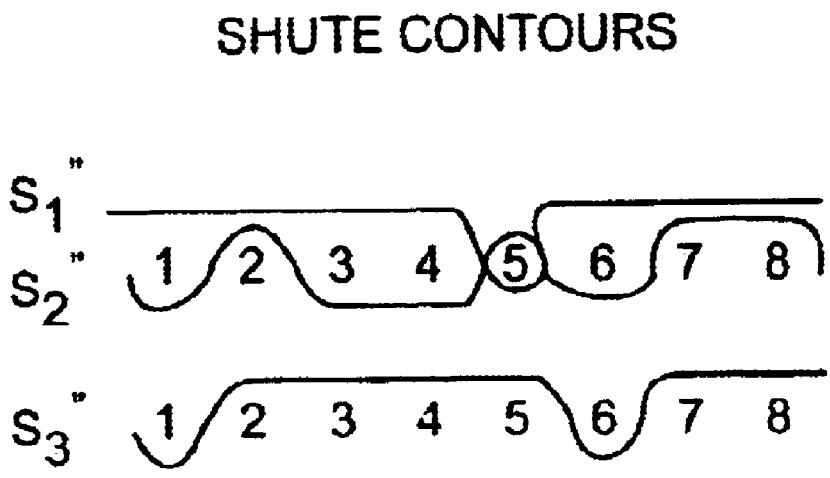
FIG. 5A is a graphic representation of the weave pattern of a third embodiment of a belt fabric according to the invention when viewed along the direction of the warp filaments.

FIGS. 5A and SB are graphic representations of the weave pattern of a third embodiment of a belt fabric according to the invention, a triple layer design. FIG. 5A shows the pattern when viewed along the in the direction of the warp filaments. As can be seen from FIG. 5A, a shute filament s1" of the first shute layer traces a first path through warp filaments 1–8, a shute filament s2" of the second shute layer traces a second path through warp filaments 1–8, and a shute filament s3" of the third shute layer traces a third path through warp filaments 1–8. The pattern for each of shute filaments s1", s2" and s3" repeats every time the shute filaments cross eight warp filaments.

Figure 5B:
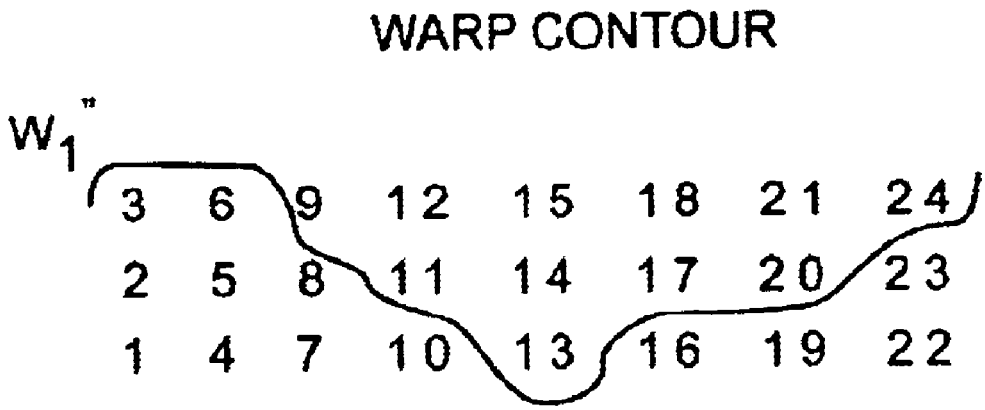
FIG. 5B is a graphic representation of the weave pattern of a third embodiment of a belt fabric according to the invention when viewed along the direction of the shute filaments.

FIG. 5B shows the triple layer when viewed along the direction of the shute filaments. As shown in FIG. 4B, a warp filament w1" traverses a path between three layers of shute filaments. The first layer is defined by shute filaments 3, 6, 9, 12, 15, 18, 21 and 24, the second layer defined by shute filaments 2, 5, 8, 11, 14, 17, 20 and 23, and the third layer is defined by shute filaments 1, 4, 7, 10, 13, 16, 19 and 22. The This pattern repeats every time the warp yarn crosses eight shute filaments of a layer.

Figure 6A:
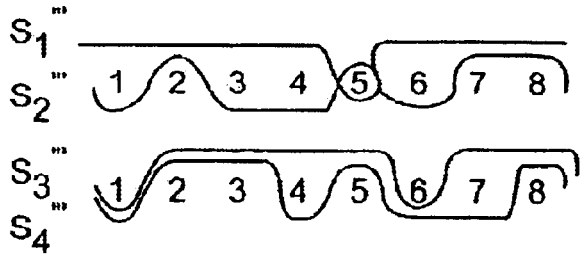
FIG. 6A is a graphic representation of the weave pattern of a fourth embodiment of a belt fabric according to the invention when viewed along the direction of the warp filaments.
Figure 6B:
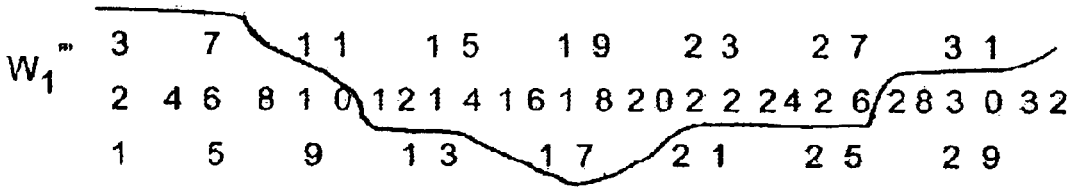
FIG. 6B is a graphic representation of the weave pattern of a fourth embodiment of a belt fabric according to the invention when viewed along the direction of the shute filaments.

FIGS. 6A and 6B are graphic representations of the weave pattern of a third embodiment of a belt fabric according to the invention, a triple layer design including a stuffer shute. FIG. 6A shows the pattern when viewed along the direction of the warp filaments. As can be seen from FIG. 6A, a shute filament s1'" of the first shute layer traces a first path through warp filaments 1–8, a shute filament s2'" of the second shute layer traces a second path through warp filaments 1–8, a shute filament s3'" of the third shute layer traces a third path through warp filaments 1–8, and a support shute filament s4'" traces a fourth path through the warp filaments 1–8. The pattern for each of shute filaments s1'", s2'", s3'" and s4'" repeats every time the shute filaments cross eight warp filaments.

FIG. 6B show the triple layer with stuffer shute embodiment when viewed along the direction of the shute filaments. As shown in FIG. 6B, a warp filament w1'" traverses a path between three layers of shute filaments and a multiple of stuffer shute filaments. The first layer is defined by shute filaments 3, 7, 11, 15, 19, 23, 27 and 31, the second layer defined by filaments 2, 6, 10, 14, 18, 22, 26 and 30, the third is layer defined by filaments 1, 5, 9, 13, 17, 21, 25 and 29, and the stuffer filaments are defined by filaments 4, 8, 12, 16, 20, 24, 28 and 32 This pattern repeats every time the warp yarn crosses eight shute filaments of a layer.

Figure 7A:
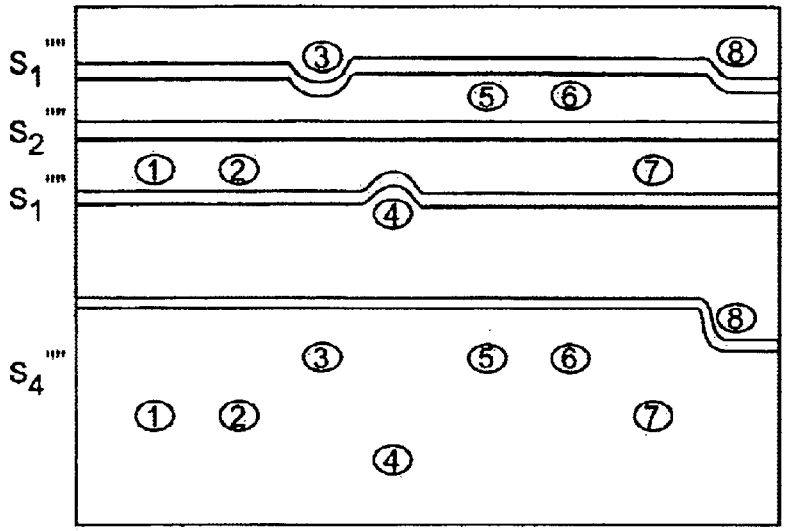
FIG. 7A is a graphic representation of the weave pattern of a fifth embodiment of a belt fabric according to the invention when viewed along the direction of the warp filaments.
Figure 7B:
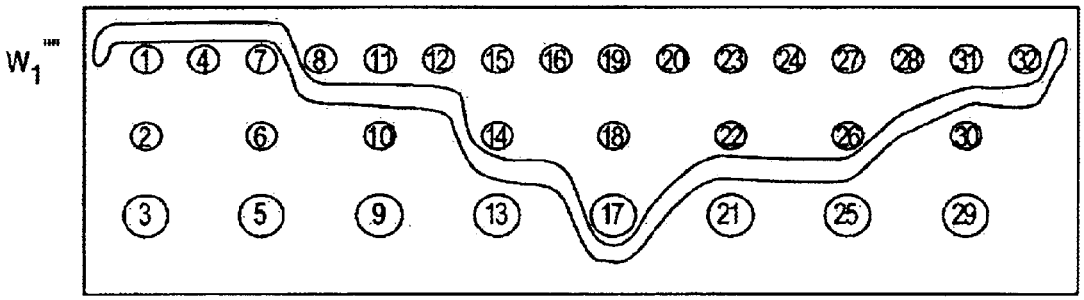
FIG. 7B is a graphic representation of the weave pattern of a fifth embodiment of a belt fabric according to the invention when viewed along the direction of the shute filaments.

FIGS. 7A and 7B are graphic representations of the weave pattern of a third embodiment of a belt fabric according to the invention, a triple layer design including a support shute. FIG. 7A shows the pattern when viewed along the direction of the warp filaments. As can be seen from FIG. 7A, a shute filament s1"" of the first shute layer traces a first path through warp filaments 1–8, a shute filament s2"" of the second shute layer traces a second path through warp filaments 1–8, a shute filament s3"" of the third shute layer traces a third path through warp filaments 1–8, and a support shute filament s4"" traces a fourth path through the warp filaments. The pattern for each of shute filaments s1"", s2"", s3"" and s4"" repeats every time the shute filaments cross eight warp filaments.

FIG. 7B shows the triple layer with support shute embodiment when viewed along the direction of the shute filaments. As shown in FIG. 7B, a warp filament w1"" traverses a path between three layers of shute filaments and a multiple of stuffer shute filaments. The first layer is defined by shute filaments 3, 7, 11, 15, 19, 23, 27 and 31, the second layer defined by filaments 2, 6, 10, 14, 18, 22, 26 and 30, the third layer is defined by filaments 1, 5, 9, 13, 17, 21, 25 and 29, and the support filaments are defined by filaments 4, 8, 12, 16, 20, 24, 28 and 32 This pattern repeats every time the warp yarn crosses eight shute filaments of a layer.

The filaments/yarns/fibers of the invention are preferably made from polyethylene terephthalate (PET), polypropylene (PP), and/or polyphenylene sulfide (PPS) for pH <7.5 applications; and from polyamide (PA) 6, 6-6, 6-10, 6-12 etc., PP, and/or PPS for pH >7 applications. The preferable range of filament size is 0.30 mm–1.00 mm, although filaments as fine as 0.12 mm and as large as 1.20 mm are envisioned. Further, it is preferable that the filaments are woven to a fabric permeability in the range of 300 to 700 cfm.

Another material suitable for use in the filaments/yarns/fibers of the invention is polyetheretherketone (PEEK). In one embodiment, PEEK is used in sheath-core yarns that have a sheath of pH protective material (PEEK) and a core of high modulus material (polyester), or a contaminant resistant PET sheath over a high modulus polymer such as DuPont's KEVLAR®. The belt made from such yarns will run clean and maintain a good drainage rate over time.

It is further noted that PEEK is the preferred material for forming any seams that may be employed in a belt according to the invention. The preferred type of PEEK seam is a spiral seam.

The washer belt of the invention possesses many advantages over prior washer belts. For one, experimental field trials have shown that drainage increases of greater than 30% have been achieved with this new design concept due to its ability to drain freely in all washing zones over a wide range of stock types. Another advantage is more consistent drainage over the run life (typically 3–12 months) of the product in operation due to the use of materials which resist contaminant adhesion in the brownstock process (PET, PP, PPS).

Further, field trials have shown no drop in drainage or washing efficiency after 5 months of operation versus the typical 5–10% drop typically reported using standard designs.

Another advantage is that belts made in accordance with the invention are easier to install due to CD dimensional stability which provides for seam end-to-end matching and easy pinning in pin seam designs.

Still another advantage is MD and CD dry to wet stability at start up and in normal operation. The belts exhibit less than 0.5% dimensional change at start up for MD or CD, 0.5% maximum MD stretch at 100 pli, and 0.1% maximum CD growth at 100 C.

Yet another advantage is that a brownstock washer employing a belt according to the invention is easier to start up due to the elimination of a break-in period which is typically needed for water absorption equilibrium to occur.

Moreover, the belts of the invention exhibit a high degree of fiber support and void volume to eliminate sheet sealing and to facilitate maximum drainage potential and production rate with minimal machine adjustment. With current industry standard designs, drainage in the formation zone is primarily achieved with the assist of vacuum, which can result in fabric sealing causing poor drainage and/or flooding the displacement zone. The high fiber support of the invention reduces the vacuum requirements in the formation zone resulting in the formation of a pulp sheet/mat that does not seal the fabric. This creates optimal conditions for the subsequent counter current washing that occurs in the displacement zone, while reducing the vacuum needed to drain in the subsequent washing zones and increasing belt life. High fiber support also improves machine flexibility in terms of its ability to handle large variations in stock consistency (freeness, fiber type/length, chip quality, H-factor, etc.).

Modifications to the present invention would be obvious to those of ordinary skill in the art in view of this disclosure, but would not bring the invention so modified beyond the scope of the appended claims.

What is claimed is:

1. A washer belt for use in a brownstock washer, comprising a fabric having a multiple layer weave and being woven in a high density weave pattern, wherein said fabric is made from one or more materials selected from the group consisting of: polyphenylene sulfide, polyetheretherketone and KEVLAR®.

2. A washer belt as claimed in claim 1, wherein said fabric is made from sheath-core yarns having a sheath of pH protective material and a core of high modulus material.

3. A washer belt as claimed in claim 2, wherein said pH protective material is polyetheretherketone and said high modulus material is polyester.

4. A washer belt as claimed in claim 1, wherein said fabric is made from sheath-core yarns having a sheath of contaminant resistant material and a core of high modulus polymer.

5. A washer belt as claimed in claim 4, wherein said contaminant resistant material is polyethylene terephthalate and said high modulus polymer is KEVLAR®.

6. A washer belt as claimed in claim 1, wherein said fabric is made from one or more materials selected from the group consisting of: metallic yarns, sintered metallic yarns, and yarns having a sintered metallic sheath over a mono core.

7. A washer belt as claimed in claim 1, wherein said fabric is woven in an eight-shed double layer weave pattern.

8. A washer belt as claimed in claim 1, wherein said fabric has a two layer weave.

9. A washer belt as claimed in claim 8, wherein said fabric includes a support shute.

10. A washer belt as claimed in claim 1, wherein said fabric has a three layer weave.

11. A washer belt as claimed in claim 10, wherein said fabric includes a support shute.

12. A washer belt as claimed in claim 10, wherein said fabric includes a stuffer shute.

13. A washer belt as claimed in claim 1, wherein said fabric is woven from monofilaments having a diameter in the range of 0.12 mm to 1.20 mm.

14. A washer belt as claimed in claim 13, wherein said fabric is woven from monofilaments having a diameter in the range of 0.30 mm to 1.00 mm.

15. A washer belt as claimed in claim 1, wherein said fabric is woven such that the permeability of said fabric is in the range of 300 cfm to 700 cfm.

16. A method of producing a washer belt for use in a brownstock washer, comprising the step of weaving a multilayer fabric in a high density weave pattern, wherein said fabric is made from one or more materials selected from the group consisting of: polyphenylene sulfide, polyetheretherketone, and KEVLAR®.

17. A method of producing a washer belt as claimed in claim 16, wherein said fabric is made from sheath-core yarns having a sheath of pH protective material and a core of high modulus material.

18. A method of producing a washer belt as claimed in claim 17, wherein said pH protective material is polyetheretherketone and said high modulus material is polyester.

19. A method of producing a washer belt as claimed in claim 16, wherein said fabric is made from sheath-core yarns having a sheath of contaminant resistant material and a core of high modulus polymer.

20. A method of producing a washer belt as claimed in claim 19, wherein said contaminant resistant material is polyethylene terephthalate and said high modulus polymer is KEVLAR®.

21. A method of producing a washer belt as claimed in claim 16, wherein said fabric is made from one or more materials selected from the group consisting of: metallic yarns, sintered metallic yarns, and yarns having a sintered metallic sheath over a mono core.

22. A method of producing a washer belt as claimed in claim 16, wherein said fabric is woven in an eight-shed double layer weave pattern.

23. A method of producing a washer belt as claimed in claim 16, wherein said step of weaving includes weaving a two-layer fabric.

24. A method of producing a washer belt as claimed in claim 23, wherein said step of weaving includes weaving a support shute into said fabric.

25. A method of producing a washer belt as claimed in claim 16, wherein said step of weaving includes weaving a three-layer fabric.

26. A method of producing a washer belt as claimed in claim 25, wherein said step of weaving includes weaving a support shute into said fabric.

27. A method of producing a washer belt as claimed in claim 25, wherein said step of weaving in includes weaving a stuffer shute into said fabric.

28. A method of producing a washer belt as claimed in claim 16, wherein said fabric is woven from monofilaments having a diameter in the range of 0.12 mm to 1.20 mm.

29. A method of producing a washer belt as claimed in claim 28, wherein said fabric is woven from monofilaments having a diameter in the range of 0.30 mm to 1.00 mm.

30. A method of producing a washer belt as claimed in claim 16, wherein said fabric is woven such that the permeability of said fabric is in the range of 300 cfm to 700 cfm.

31. A washer belt for use in a brownstock washer, produced by weaving a multi-layer fabric in a high density weave pattern, wherein said fabric is made from one or more materials selected from the group consisting of: polyphenylene sulfide, polyetheretherketone, and KEVLAR®.

32. A washer belt as claimed in claim 31, wherein said fabric is made from sheath-core yarns having a sheath of pH protective material and a core of high modulus material.

33. A washer belt as claimed in claim 32, wherein said pH protective material is polyetheretherketone and said high modulus material is polyester.

34. A washer belt as claimed in claim 31, wherein said fabric is made from sheath-core yarns having a sheath of contaminant resistant material and a core of high modulus polymer.

35. A washer belt as claimed in claim 34, wherein said contaminant resistant material is polyethylene terephthalate and said high modulus polymer is KEVLAR®.

36. A washer belt as claimed in claim 31, wherein said fabric is made from one or more materials selected from the group consisting of: metallic yarns, sintered metallic yarns, and yarns having a sintered metallic sheath over a mono core.

37. A washer belt as claimed in claim 31, wherein said fabric is woven in an eight-shed double layer weave pattern.

38. A washer belt as claimed in claim 31, wherein said fabric has a two layer weave.

39. A washer belt as claimed in claim 38, wherein said fabric includes a support shute.

40. A washer belt as claimed in claim 31, wherein said fabric has a three layer weave.

41. A washer belt as claimed in claim 40, wherein said fabric includes a support shute.

42. A washer belt as claimed in claim 40, wherein said fabric includes a stuffer shute.

43. A washer belt as claimed in claim 31, wherein said fabric is woven from monofilaments having a diameter in the range of 0.12 mm to 1.20 mm.

44. A washer belt as claimed in claim 43, wherein said fabric having a diameter in the range of 0.30 mm to 1.00 mm.

45. A washer belt as claimed in claim 31, wherein said fabric is woven such that the permeability of said fabric is in the range of 300 cfm to 700 cfm.

* * * * *

UNITED STATES PATENT AND TRADEMARK OFFICE

CERTIFICATE OF CORRECTION

PATENT NO. : 6,769,535 B2 
DATED : August 3, 2004
INVENTOR(S) : Gregory Zilker, Mark Levine and John VanHandel It is certified that error appears in the above-identified patent and that said Letters Patent is hereby corrected as shown below:

Title page, Item [54] and Column 1, line 1,
Title, "DIMENSIONALLALLY" should be -- DIMENSIONALLY --

Signed and Sealed this

Thirtieth Day of November, 2004

JON W. DUDAS
*Director of the United States Patent and Trademark Office*